US008998521B2

(12) United States Patent
Weigel

(10) Patent No.: US 8,998,521 B2
(45) Date of Patent: Apr. 7, 2015

(54) COSMETICS UNIT WITH LATCHING CLOSURE THAT CAN BE BLOCKED

(75) Inventor: Friedrich Weigel, Wittelshofen (DE)

(73) Assignee: GEKA GmbH, Bechhofen (DE)

( * ) Notice: Subject to any disclaimer, the term of this patent is extended or adjusted under 35 U.S.C. 154(b) by 435 days.

(21) Appl. No.: 13/462,101

(22) Filed: May 2, 2012

(65) Prior Publication Data

US 2012/0279876 A1 Nov. 8, 2012

(30) Foreign Application Priority Data

May 3, 2011 (DE) ..... 20 2011 100 183 U

(51) Int. Cl.
*A46B 11/00* (2006.01)
*A45D 40/26* (2006.01)
*A45D 40/00* (2006.01)

(52) U.S. Cl.
CPC ..... *A45D 40/265* (2013.01); *A45D 40/00* (2013.01)

(58) Field of Classification Search
USPC ..... 401/121, 122, 126–130; 132/218
See application file for complete search history.

(56) References Cited

U.S. PATENT DOCUMENTS

| | | | | |
|---|---|---|---|---|
| 5,141,347 | A * | 8/1992 | Fitjer | 401/126 |
| 5,160,057 | A * | 11/1992 | Fitjer | 215/44 |
| 7,118,298 | B2 * | 10/2006 | Tsutsumi | 401/129 |
| 7,503,718 | B2 * | 3/2009 | Hamada | 401/127 |
| 8,702,333 | B2 * | 4/2014 | Geuther | 401/129 |
| 2011/0058889 | A1 | 3/2011 | Hartstock et al. | |
| 2012/0282009 | A1 | 11/2012 | Geuther | |
| 2014/0147188 | A1 * | 5/2014 | Lefol | 401/121 |

FOREIGN PATENT DOCUMENTS

| | | | |
|---|---|---|---|
| DE | 102009011026 | A1 | 9/2010 |
| DE | 202011100181 | U1 | 9/2012 |
| EP | 1800561 | A1 | 6/2007 |

* cited by examiner

*Primary Examiner* — David Walczak
*Assistant Examiner* — Jennifer C Chiang

(57) ABSTRACT

A cosmetics container for a liquid or pasty cosmetic, comprising a storage container having a removal opening, and a closure cap for opening and closing this removal opening. The closure cap can be detachably locked in its closing position on the storage container using at least one latching device that acts between the closure cap and the storage container. The cosmetics container further comprises at least one locking device which is able to assume at least one release position and at least one blocking position, and which in the blocking position blocks the latching element in such a way that a lock existing between the closure cap and the storage container cannot be released and the closure cap thus cannot be moved out of its closing position.

10 Claims, 10 Drawing Sheets

COSMETICS UNIT WITH LATCHING CLOSURE THAT CAN BE BLOCKED

FIELD OF THE INVENTION

The invention relates to a cosmetics container for a liquid or pasty cosmetic, comprising a storage container having a removal opening, and comprising a closure cap for opening and closing the removal opening.

BACKGROUND OF THE INVENTION

Cosmetics containers of this type serve for transporting, selling and/or storing a cosmetic with a liquid or pasty consistency accommodated in the storage container, such as, for example, mascara, lip gloss or the like. The cosmetic located in the storage container can be withdrawn by the user in the desired amount through the removal opening. The removal opening can be closed with a closure cap (cover) belonging to the cosmetics container in order to prevent accidental leaking of the cosmetic and to protect the cosmetic, e.g. from drying up. It is known to provide an applicator on the closure cap with which the cosmetic can be specifically removed and applied.

The closure cap is most frequently detachably fastened on the storage container by means of a threaded connection. In addition, so-called threadless closure mechanisms are also known in which the closure cap can be detachably locked in its closing position on the storage container by means of at least one latching means that acts between the closure cap and the storage container. The lock can be released again by manually applying a tensile force on to the closure cap. In the case of the known cosmetics containers with threadless closure mechanisms, this lock is at times released accidentally, so that cosmetic agents can leak out and/or dry up.

It is an object of the invention to propose a cosmetics container of the type mentioned in the introduction with an improved threadless closure mechanism.

SUMMARY OF THE INVENTION

The cosmetics container according to the invention comprises a storage container for accommodating the liquid or pasty cosmetic with a removal opening and a closure cap for selectively opening and closing this removal opening. The closure cap can be detachably locked, i.e. fixed by positive fit, on the storage container in its closing position closing off the removal opening, by at least one latching device that acts between the closure cap and the storage container in such a way that the closure cap cannot easily become detached from the storage container. This latching device consists of latching elements that engage one another in a positive fit. The primary purpose of this latching device is only to generate locking forces in the above-mentioned sense, i.e. it is desirable, but not mandatory, that the latching device fixes the closure cap non-rotatably on the storage container.

According to the invention, it is provided that the cosmetics container comprises at least one locking device which is able to assume at least one release position (unlocking position) and at least one blocking position (locking position), and which in the blocking position blocks the latching device in such a way, while the closure cap is mounted, that the lock existing between the closure cap and the storage container cannot be released and the closure cap thus cannot be moved out of its closing position. The locking device is preferably an additional device separate from the latching device.

In particular, it is provided that the cosmetics container comprises at least one locking device that can be brought into at least one blocking position, in which it bars or blocks at least one latching device, and preferably all latching devices, in such a way that the positive fit between the closure cap and the storage container associated with the lock cannot be canceled, and that this locking device can be brought into at least one release position in which it releases the at least one latching device so that the positive fit or lock between the closure cap and the storage container can be released. As a rule, the latching device will comprise several latching elements, at least one of which has to become elastically deformed in order to unlatch and thus release the closure cap. In that case, the locking device is configured in such a way that it inhibits the elastic deformation of the respective latching element of the latching device when it is in its blocking position.

In the case of the cosmetics container according to the invention, an accidental leaking and/or drying up of the contained cosmetic can be prevented. At the same time, it becomes possible (even if that is not absolutely necessary) to design the latching device in such a way that it moves relatively smoothly and therefore is easy to actuate as long as it is not blocked. This enhances its ease of operation without reducing leak protection. Moreover, a very high-quality appearance can optionally also be achieved by the proposed closure mechanism.

Preferably, it is provided that the latching device comprises at least one latching hook, which is disposed on the closure cap or on the storage container and is configured to be resilient, which is able to resiliently engage a corresponding projection on the storage container or on the closure cap in order to effect the lock, and that the locking device situated in the blocking position blocks the resilient disengagement of the engaging latching hooks and thus prevents the release of the lock. The latching hook(s) is/are blocked in particular in a radial direction. Preferably, the latching hook is an integral part of the closure cap or of a component of the closure cap. Preferably, the latching hook has the form of a leaf spring clamped in or rooted at one end thereof, which comprises a hook-like protection at its freely cantilevering end. The cross section of the leaf spring is preferably square or better rectangular. Ideally, it is between 0.5 mm×0.5 mm and 2 mm×2 mm, wherein the upper limit may in individual cases be slightly higher, i.e. 3 mm×3 mm maximally. The latching hook is preferably fabricated from an elastic plastic. Typically, the latching hook has in its relaxed condition a longitudinal axis which is parallel to the longitudinal axis of the closure cap. In this case, the longitudinal axis of the latching hook is considered to be the axis of the latching hook that extends in the direction of its greatest length.

Preferably, it is further provided that the locking device can be moved by of an actuating element that is movably mounted on the storage container or on the closure cap, for which purpose this actuating element itself can be moved between at least one blocking position (which corresponds to a blocking position of the locking device) and at least one release position (which corresponds to a release position of the locking device). Such an actuating element may be, for example, a rotary slide which is to be grasped by the user with her fingers and then actuated by rotation, and which, depending on the rotational position it is located in, rests directly on the latching device and blocks it or does not rest on the latching device and thus releases it. Such a rotary slide is realized by the exemplary embodiment described later in the form of a "rotary sleeve". Alternatively, a sliding bar that is to be actuated by longitudinal displacement can be used which is to be grasped by the user with her fingers and then actuated by displacement in the direction of the longitudinal axis of the container and/or its closure cap. Depending on which displaced position it is situated in, the sliding bar rests directly against the latching device and blocks it, or it does not rest against the latching device and thus releases it. Such a sliding bar is realized by the exemplary embodiment described later in the form of a "sliding sleeve".

In particular, it is provided that the actuating element is biased into the blocking position by at least one spring device, such as e.g. a torsion spring or spiral spring. In this way, it is ensured that the blocking of the closure cap is not omitted due to carelessness.

Preferably, it is further provided that the actuating element is a sliding sleeve, with this sliding sleeve being mounted longitudinally displaceably on the outer face of the container so as to at least partially enclose the neck of the storage container, and preferably also being retained in a loss-proof manner. Ideally, the sliding sleeve is configured in such a way that, utilizing its inherent elasticity and/or that of the storage container, it can be latched onto the storage container during the first assembly in such a way that it is retained so as to be movable between at least one release position and at least one blocking position, but retained captively.

The cosmetics container according to the invention can comprise a device or mechanism (consisting of several cooperating elements or components) that converts a rotary movement applied to the closure cap into a longitudinal movement of the sliding sleeve, whereby the sliding sleeve can be moved out of its blocking position by rotating the closure cap. This is preferably achieved by cams attached to the closure cap and/or the sliding sleeve (or by a cam-like or wave-like curve profile, or a profile corresponding to a face toothing). Such an embodiment permits a particularly convenient operation because the user does not first have to deal with how the closure is to be actuated or unlocked, but is able to intuitively open the closure cap by the customary rotary movement.

Furthermore, the cosmetics container according to the invention can comprise a device or a mechanism that automatically causes or at least aids the lock caused by the latching device between the closure cap and the storage container to be overcome when the actuating element is moved out of the blocking position.

Such a mechanism can be formed by, for example, a closure cap of at least two-part design, whose parts are pressed axially apart by at least one spring device in order thus to generate an opening force acting against the lock. Such a mechanism is explained in more detail below in connection with the Figures. Such a mechanism can, for example, also be realized by using at least one tilting lever which, by being pivoted, applies an opening force acting against the lock to the closure cap when the actuating element is moved out of the blocking position. Such a mechanism is also explained in more detail below in connection with the Figures.

Preferably, the storage container is configured as a cylindrical elongate container, i.e., the axial length of the storage container exceeds its diameter many times. Moreover, it is preferably provided that the closure cap is configured with a handle section and a carrier rod disposed thereon with an applicator. A cosmetics container according to the invention configured in this manner is, in particular, a so-called mascara pen.

Further advantages, mechanisms of action and optional embodiments of the invention become apparent from the exemplary embodiments explained below with reference to various Figures.

DETAILED DESCRIPTION OF THE PREFERRED EMBODIMENTS

Figure 1:
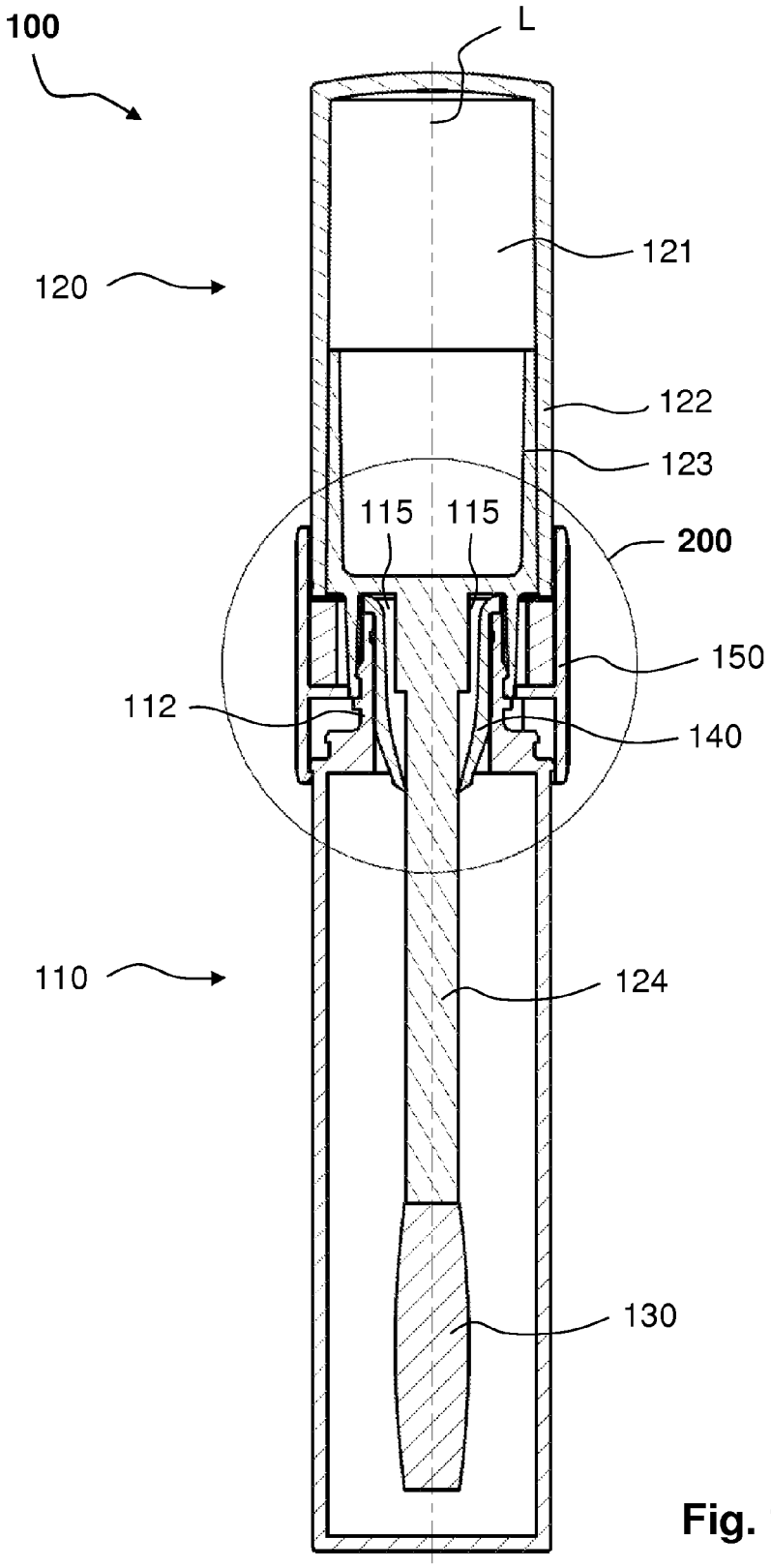
FIG. 1 shows a sectional view of a first exemplary embodiment of a cosmetics container according to the invention.

First of all, it must be remarked that identical and/or functionally identical components have been provided with the same reference numerals in the Figures. In the exemplary embodiment two, three, four and five, however, the reference numerals have been additionally provided with the letters a, b, c and d. Within the context of the invention, the features shown in the different exemplary embodiments can be combined to form new exemplary embodiments. Features that are shown only in connection with one exemplary embodiment are general features of the invention at the same time.

FIG. 1 shows a first exemplary embodiment of a cosmetics container 100 according to the invention. A preferably cylindrically configured, elongate storage container 110 and a closure cap 120 for closing and clearing a removal opening 115 located at the outer end of a neck 112 on the storage container 110 belong to the cosmetics container 100. In the illustration shown, the mounted closure cap 120 is in its closing position in which it closes the removal opening 115 and in the process protrudes into an accommodating portion of a sliding sleeve 150. The common longitudinal axis is marked with L. The closure cap 120 comprises a handle section 121 with a carrier rod 124 retained thereon. An applicator 130 is attached to the distal axial end of the carrier rod 124, i.e. the end facing away from the handle section 121. The applicator 130 is preferably a brush, but can also be a smooth-surface or sponge applicator or paintbrush. If the closure cap 120 is mounted, the applicator is located inside the storage container 110. A liquid or pasty cosmetic, such as, for example, mascara which can be removed and applied by using the applicator 130 is located inside the storage container 110.

The closure cap 120 preferably has a multi-part configuration and in that case consists of a first outer part or outer part 122 and an inner part or inner part 123. The latter is preferably configured integrally with the carrier rod 124. Preferably, it is provided in this case that the parts 122 and 123 are fabricated from different materials. Thus, the inner part 123 can consist, for example, of plastic and be configured as an injection-molded article, and the outer part 122 can consist of metal and be configured as a deep-drawn part. Preferably, the parts 122 and 123 are latched to one another or possibly only wedged into one another in a frictional fit, otherwise adhesively bonded.

In order to withdraw the cosmetic located inside the storage container 110, the closure cap 120 is removed from the storage container 110, for which purpose the closure cap 120 and the storage container 110 are separated in the axial direction L after the closure mechanism 200 has be actuated. In the process, the carrier rod 124 is withdrawn together with the applicator 130 from the removal opening 115. A wiper 140 causes the cosmetic to be wiped off the carrier rod 124 and the cosmetic located on the applicator 130 to be dosed. If the closure cap 120 is mounted, the applicator 140 preferably also provides a seal.

Figure 2A:
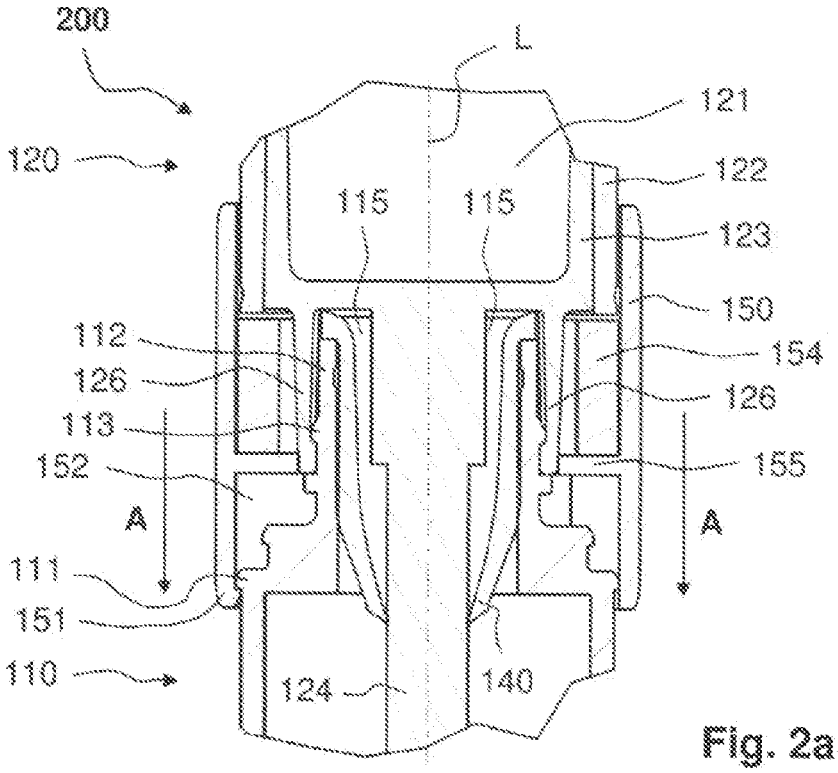
FIG. 2 shows two detailed sectional views of the closure mechanism of the cosmetics container from FIG. 1.
Figure 2B:
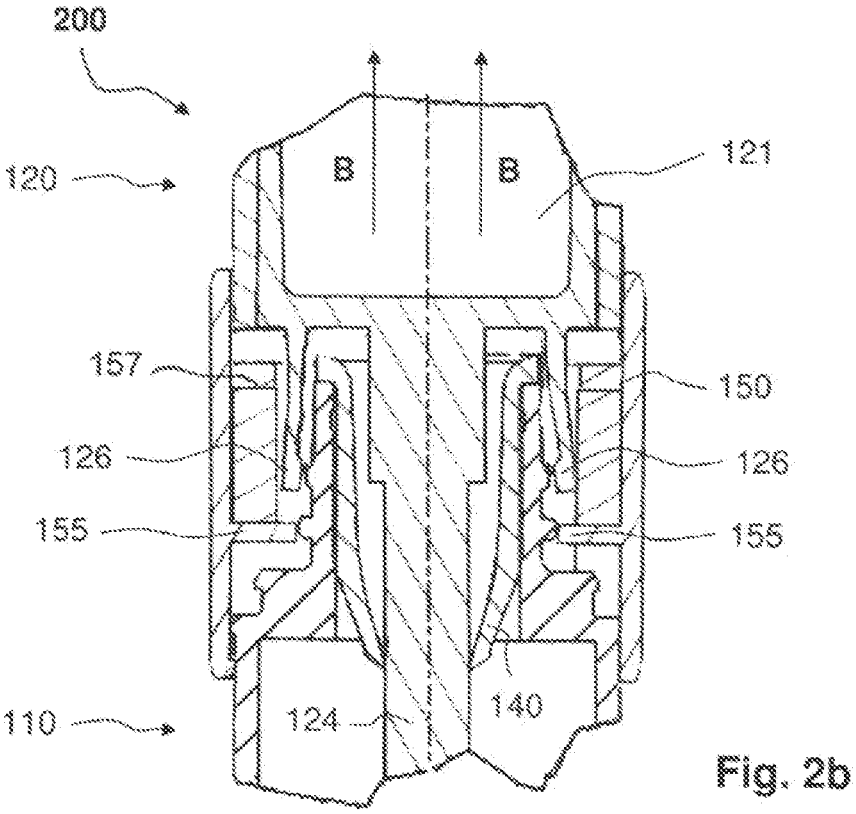

In order to detachably fasten the closure cap 120 on the storage container 110, a threadless closure mechanism 200 is provided, as is subsequently explained in more detail with reference to FIG. 2. FIG. 2*a* shows a detailed view of the closure mechanism 200 according to the area marked in FIG. 1.

Latching elements that engage one another in a positive fit are provided in order to lock the closure cap 120 mounted on the storage container 110 in the closing position on the storage container 110 shown in FIG. 2*a*. In the exemplary embodiment shown, several latching or spring hooks 126 are formed on the closure cap 120 which, when the closure cap 120 is mounted on the storage container 110, grasp over the neck 112 of the storage container 110 and there latch into a latching depression in a positive fit. In this exemplary embodiment, the latter is delimited by a radially outwardly protruding shoulder 113 on the outer face of the neck 112, as is shown in FIG. 2*a*. The latching depression or shoulder 113, on the side thereof facing towards the removal opening 115, is provided with an oblique sliding surface. The free ends of the latching hooks 126 slide off on it when the closure cap 120 is mounted. Thus, they are elastically deflected radially outwards and are thus able to run over the shoulder 113 without any particular force being exerted until finally, they are able to resiliently latch into the latching depression behind the shoulder 113. In order to remove the closure cap 120, a tensile force in the axial direction is applied to the closure cap 120 via the handle section 121, which, when a certain amount is exceeded, leads to the latching hooks 126 latched behind the shoulder 113 resiliently disengaging and releasing the lock. For this purpose, oblique sliding surfaces are attached either on the latching hooks 126 and/or on the flank of the latching depression which elastically deflect the latching hooks radially outwards under the influence of said tensile force and thus let them become unlatched again from the latching depression.

According to the invention, at least one locking device is provided which can be brought into a blocking position in which it blocks at least one latching device, whereby the closure cap 120 cannot be moved out of its closing position and removed from the storage container 120 even under the influence of a tensile force.

In the exemplary embodiment shown, a blocking ring 155 is provided for this purpose which in the blocking position rests radially outside on all latching hooks 126 and thus prevents the latching hooks 126 from resilient disengaging in the radial direction, as is shown in FIG. 2*a*. The blocking ring 155 is formed as a radially inward-facing projection on the inner face of a sliding sleeve 150, i.e. the outer circumference of the blocking ring is connected to the inner surface of the sliding sleeve 150 and the inner circumference of the blocking ring 155 serves for blocking the latching hook. The sliding sleeve 150 is preferably fabricated as a single piece, e.g. from a plastic material or as a metal turned part, in order to achieve a particularly high-quality appearance.

The sliding sleeve 150 is mounted so as to be axially displaceable around the neck 112 on the outer face of the storage container 110 and can be moved back and forth between a blocking position (FIG. 2*a*) and at least one release position (FIG. 2*b*), wherein the blocking ring 155 is moved with it and correspondingly assumes a blocking position (FIG. 2*a*) or a release position (2*b*). The sliding sleeve 150 comprises a cylindrical inner face 152 that serves for axial guidance on the storage container 110. The radially inward-facing collar 151 on the sliding sleeve 150 and the radially outward-facing collar 111 on the storage container 110 form a securing element for the sliding sleeve 150 and moreover define an axial end position for the sliding sleeve 150. Said collars, or the wall thickness of the parts forming them, are dimensioned in such a way that the sliding sleeve can be expanded elastically and reversibly during assembly to such an extent that the collars can be pushed over each other so that the sliding sleeve can arrive in its future loss-proof position on the storage container 110. The preferably annular inner part 157 inserted into the sliding sleeve 150 forms a stop for the handle section 121 of the closure cap 120. In addition, this inner part 157 in many cases causes a reinforcement of the sliding sleeve 150 and preferably also prevents an excessive radial deflection of the latching hooks 126.

In order to be able to remove the closure cap 120, which is mounted on the storage container 110 and located in the closing position, from the storage container 110, the sliding sleeve 150 first has to be moved out of the blocking position shown in FIG. 2*a*. To this end, the sliding sleeve 150 is manually moved away from the closure cap 120 in the axial direction, which is indicated by the arrows A in FIG. 2*a*, with the blocking ring 155 barring the latching hooks 126 also being moved out of its blocking position. In the process, the bar or radial block of the latching hooks 126 is canceled. In the illustration depicted in FIG. 2*b*, the sliding sleeve 150 is in a release position and the blocking ring 155 in a release position in which the latter no longer blocks the radial movement of the latching hooks 126. By applying to the closure cap 120 an axially acting tensile force pointing away from the storage container 110, the lock caused by the latching hooks 126 latching behind the shoulder 113 can now be released and the closure cap 120 can be axially moved and finally removed. This is indicated by the arrows B in FIG. 2*b*.

Figure 3:
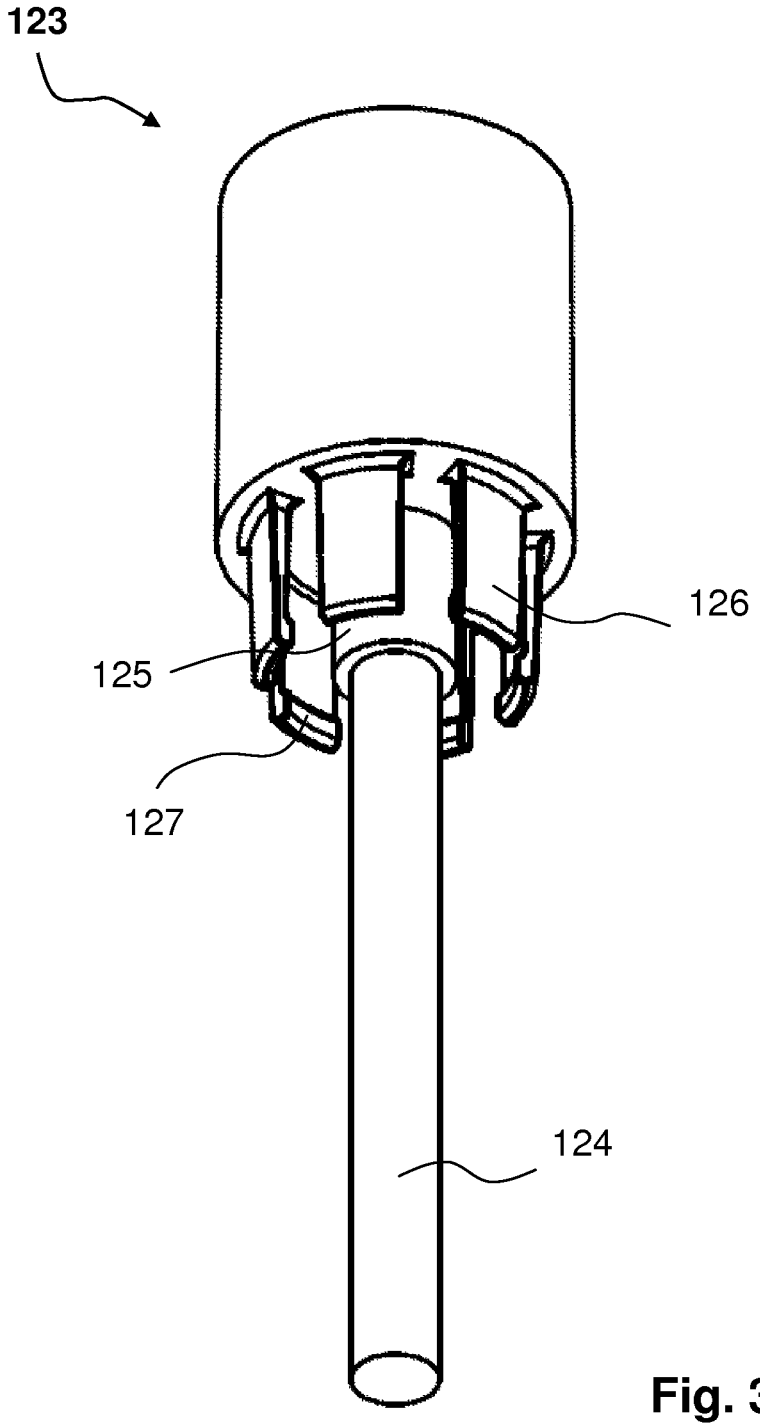
FIG. 3 shows a perspective view of the inner part of the closure cap of the cosmetics container from FIG. 1.

In the exemplary embodiment described above, the latching hooks 126 are formed integrally with the inner part 123 of the closure cap 120. This is shown by FIG. 3, wherein the integral configuration in this case also includes the carrier rod 124, which, however, only constitutes a preferred design. The six latching hooks 126 in total (wherein more or fewer latching hooks 126 may be provided; preferably, the number of latching hooks is between three and eight) are disposed on an annular face along a circular line on the side of the carrier rod 124. In this exemplary embodiment, they surround the reinforced base 125 of the carrier rod 124. The free ends of the latching hooks 126 are configured with radially inward-facing latching lugs 127. The latching hooks are each configured as leaf springs clamped in or rooted at their one small face, whose free length (=distance from the root to the tip, seen in the longitudinal direction L) is at least ⅓, better ½, of the length of the bottle neck (also seen in the longitudinal direction).

Figure 4:
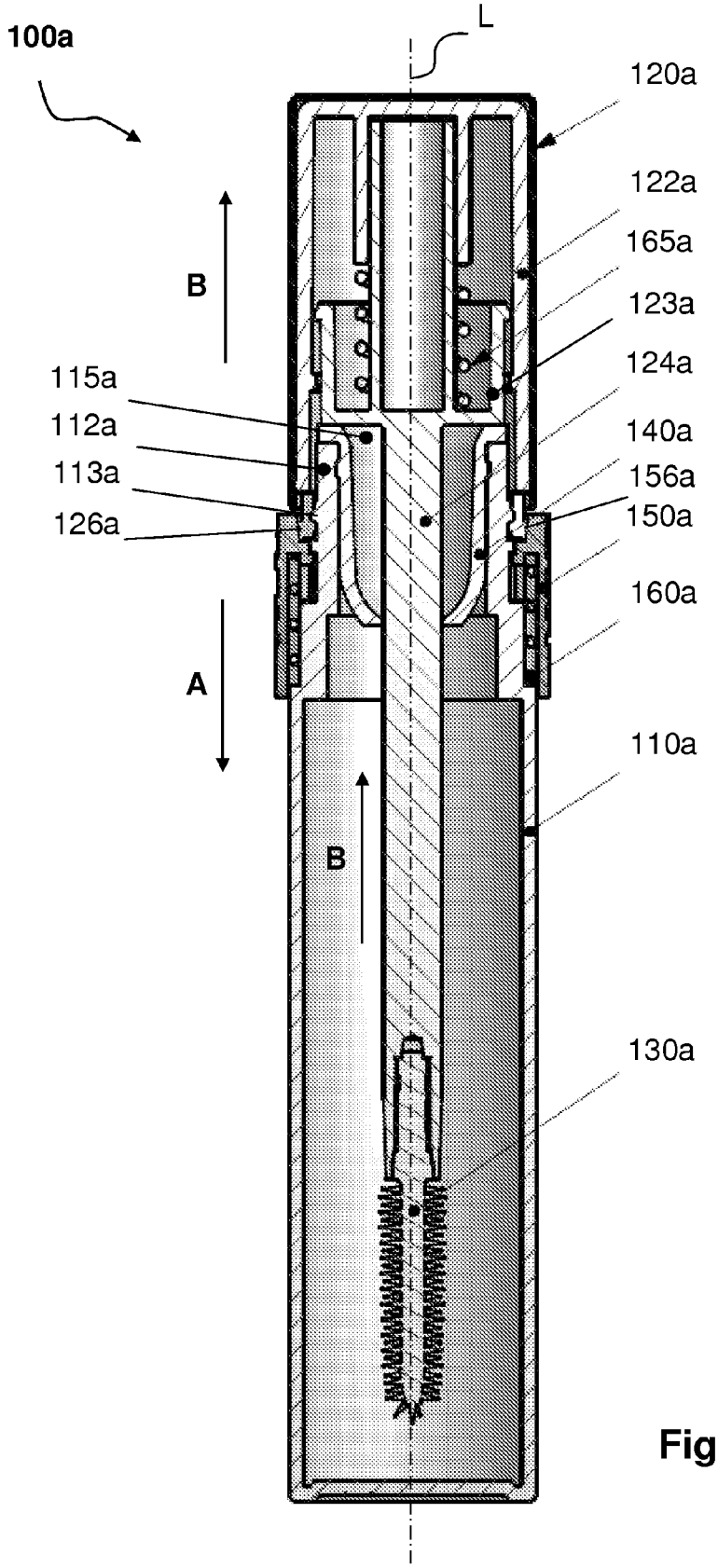
FIG. 4 shows a sectional view of a second exemplary embodiment of a cosmetics container according to the invention.

FIG. 4 shows a second exemplary embodiment of a cosmetics container 100*a* according to the invention. Apart from the differences described below, the closure mechanism as such is identical to the closure mechanism of the first exemplary embodiment, so that the statements above in connection with the first exemplary embodiment also apply to this second exemplary embodiment unless the description below does not explicitly specify otherwise.

Deviating from the first exemplary embodiment, the sliding sleeve 150*a* is in this case a spring device 160*a*, wherein this is preferably a helical spring biased into the blocking position. In order to move the sliding sleeve 150*a* from the blocking position shown in FIG. 4 into a releasing position, it must be manually moved away from the closure cap 120*a* in opposition to the spring action of the spring device 160*a*. After removing the closure cap 120*a*, the sliding sleeve 150*a* automatically returns to its blocking position, even without the closure cap 120*a* being mounted. When the closure cap 120*a* is mounted, the sliding sleeve 150*a* is pushed away from the latching hooks 126*a* in opposition to the spring action of the spring device 160*a* until the free ends or latching lugs of the latching hook 126*a* are able to latch behind the shoulder 113*a* or into the recess provided for this purpose on the outer face of the neck 112*a* of the storage container 110*a*, whereby the lock is effected. Then, the sliding sleeve 150*a* automatically pushes over the free ends of the latching hooks 126*a*, which causes a bar or radial block. The block is in this case caused by a cylindrical inner face section 156*a* on the sliding sleeve 150*a*.

In this case, the shoulder 113*a* (or, more generally, the edge of the latching depression) and the end face of the sliding sleeve facing towards the handle side are disposed, relative to one another, and dimensioned in such a way that the latching hooks 126*a* are deflected radially outwards upon abutting against the shoulder 113*a* when the closure cap 120*a* is being pushed back on the cosmetics container 110*a*, thus abut for the first time against the end face of the sliding sleeve 150*a* facing towards the handle side with their end face facing away from the handle side, and thus push the sliding sleeve 150*a* in the direction of the longitudinal axis L towards the bottom of the cosmetics container 110*a*. The sliding sleeve thereby clears the way for the latching hooks 126*a* into the latching depressions associated with them. Once the latching hooks 126*a* have reached their end position over the latching depressions associated with them, they spring back in the radially inward direction and completely insert themselves into the associated latching depression. Thus, the end face of the sliding sleeve 150*a* facing towards the handle side is released and the sliding sleeve 150*a* snaps over the latching hooks 126*a* in such a way that they are blocked in their positions in the latching depressions.

Deviating from the first exemplary embodiment, the cosmetics container 100*a* in this exemplary embodiment (preferably and irrespective of whether or not the sliding sleeve is biased by a spring member) comprises a device or mechanism (of several cooperating components) which aids or even automatically causes the lock between the mounted closure cap 120*a* and the storage container 110*a* caused by the engaging latching hooks 126*a* to be overcome when the closure cap 120*a* is removed from the storage container 110*a*, after the sliding sleeve 150*a* was moved from the blocking position into a release position.

For this purpose, the closure cap 120*a* is formed from two parts 122*a* (outer part) and 123 (inner part) that are axially moveable relative to one another. A spring device 165*a* that operates between the outer part 122*a* and the inner part 123*a* is disposed in the hollow handle section 121*a*, this being, for example, a helical spring which presses the two parts 122*a* and 123*a* apart in the axial direction. After the sliding sleeve 150*a* has been manually moved out of the blocking position and the radial block of the latching hooks 126*a* by the inner face section 156*a* on the sliding sleeve 150*a* has thus been canceled, the outer part 122*a* of the closure cap 120*a*, on which the latching hooks 126*a* are also disposed, can also be withdrawn from the storage container 110*a* by the spring device 160*a*, with the inner part 123*a* of the closure cap 120*a* in the process being supported by the end face or edge of the removal opening 115*a* of the storage container 110*a*.

When the closure cap 120*a* is mounted on the storage container 110*a*, the spring device 165*a* is biased. The spring force that then originates from the spring device 165*a* and the resulting opening force acting against the lock is permanently active but is unable to come to bear as long as the lock is effectively blocked by the sliding sleeve 150*a* or by the inner face section 156*a* thereof.

Other design configurations such as guiding surfaces, end stops and the like are apparent from FIG. 4. According to it, the outer part 122*a* of the closure cap has on its inner circumference at least one stop against which the inner part runs when the closure cap 120*a* is removed. The stop prevents the inner and the outer part of the closure cap from moving apart under the influence of the spring force.

Here, the inner part comprises a central piston section that dips into a central cylinder section of the outer part and guides these two parts so that they slide relative to one another. The piston section of the inner part is in some areas surrounded by a cup section of the inner part, the function of which will be explained in more detail later. The piston section at the same time serves for guiding the helical spring which forms the spring member in this exemplary embodiment. The piston section is configured to be so long that it rests against a stop on the outer part when the latter is in its locking position. Thus, the outer part is able, by a direct positive fit, to press the inner part tightly against the bottle neck or the collar of the wiper grasping over the end face of the bottle neck and keep it locked there. An improved protection against inadvertent leaking is thus achieved because tightness is not dependent upon whether the spring is able to ensure the required pressure at all times—which is otherwise not always the case, e.g. when the cosmetics unit is accidentally dropped and hits the floor in such a way that the inertia forces temporarily overcome the spring force, to have to rely on the spring.

The cup section constitutes an organ which, in particular in the radial direction, is inwardly elastic and which is provided with a stopping bead, or, more generally speaking, a stopping organ. When the inner part and the outer part are assembled and the spring is inserted, the cup section resiliently yields in the radially inward-facing direction at the moment in which the stopping bead or the stopping organ runs over the at least one stop on the inner face of the outer part. In this way, the outer part and the inner part can be latched into one another in such a way that the distance by which the spring member is able to push the outer and the inner part apart is limited, in the manner that was already described above.

The extent to which the release of the lock is to be supported can be determined by the design of the spring device 160*a*. Providing such a device or such a mechanism permits large locking forces without the removal of the closure cap 120*a* becoming perceivably harder. Moreover, a perceivably gentler removal of the closure cap 120*a* from the storage container 110*a* can be realized.

Other differences in the design of the second exemplary embodiment compared with the first exemplary embodiment are apparent from FIG. 4. Apart from the explained and depicted differences, the second exemplary embodiment comprises all the features of the first exemplary embodiment.

Figure 5:
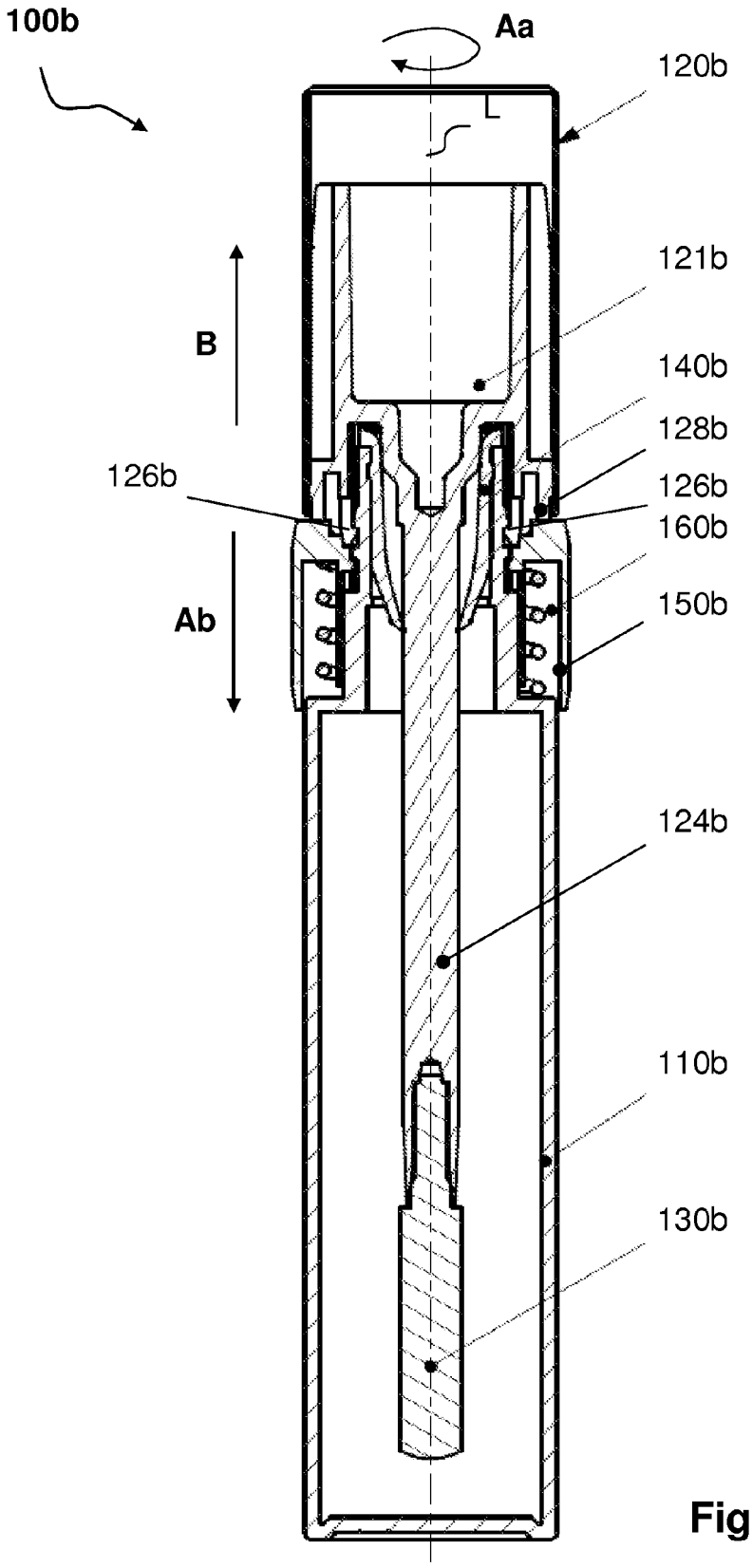
FIG. 5 shows a sectional view of a third exemplary embodiment of a cosmetics container according to the invention.

FIG. 5 shows a third exemplary embodiment of a cosmetics container 100*b* according to the invention.

Apart from the differences described below, the closure mechanism as such is identical to the closure mechanism of the first exemplary embodiment, so that the statements above in connection with the first exemplary embodiment also apply to this second exemplary embodiment unless the description below does not explicitly specify otherwise.

Deviating from the first exemplary embodiment, the sliding sleeve 150*b* can be moved out of the closing position shown in FIG. 5 by rotating the closure cap 120*b*. The cosmetics container 100*b* comprises a device or mechanism (consisting of several cooperating components) that converts a rotary movement manually applied to the closure cap 120*b* (relative to the storage container 110*b*) into an axial longitudinal movement of the sliding sleeve 150*b* directed away from the closure cap 120*b*. For this purpose, a curve profile 128*b* is formed on the end face of the closure cap 120*b* facing towards the storage container 110*b*, which, when the closure cap 120*b* is rotated, slides off the non-rotatable sliding sleeve 150*b* on several contact points, with the sliding sleeve 150*b* being pressed away from the closure cap 120*b* in the axial direction and moved out of its blocking position in the process. The spring device 160*b*, which as an example is a helical spring, causes the sliding sleeve 150*b* to be biased into the blocking position and ensures a touching contact between the closure cap 120*b* and the sliding sleeve 150*b* required for converting the rotary movement into an axial longitudinal movement.

Figure 6A:
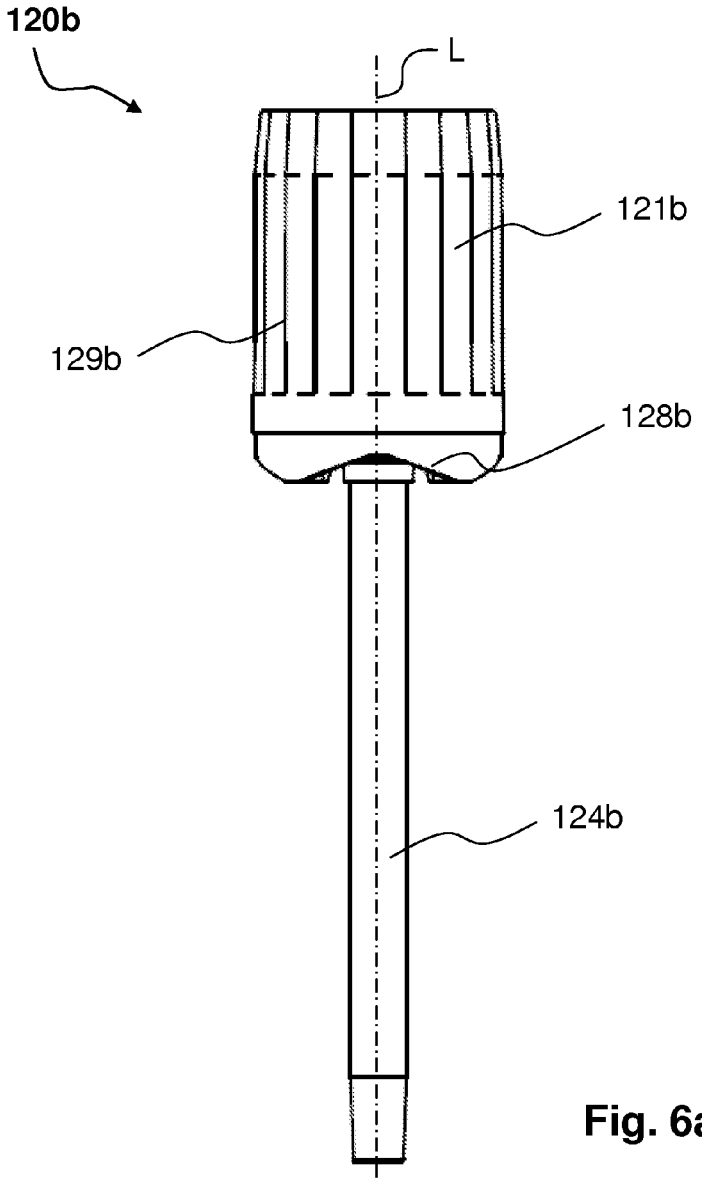
FIG. 6 shows a side view of the closure cap and a perspective view of the sliding sleeve of the cosmetics container from FIG. 5.

FIG. 6*a* shows the closure cap 120*b* in a side view. The handle section 121*b* is configured with a furrowed portion 129*b* in order to ensure a non-rotatable connection between the handle section 121*b* and a decorative cap (see FIG. 5) mounted thereon. The lower edge of the handle section 121*b* facing towards the sliding sleeve 150*b* is configured with a wave-like curve profile 128*b* which is preferably designed in such a way that it is reminiscent of a face toothing. The closure cap 120*b* is composed of several parts (outer part and inner part) (see FIG. 5). The closure cap 120*b*, e.g. a plastic injection-molded part, may also be formed as a single piece.

Figure 6B:
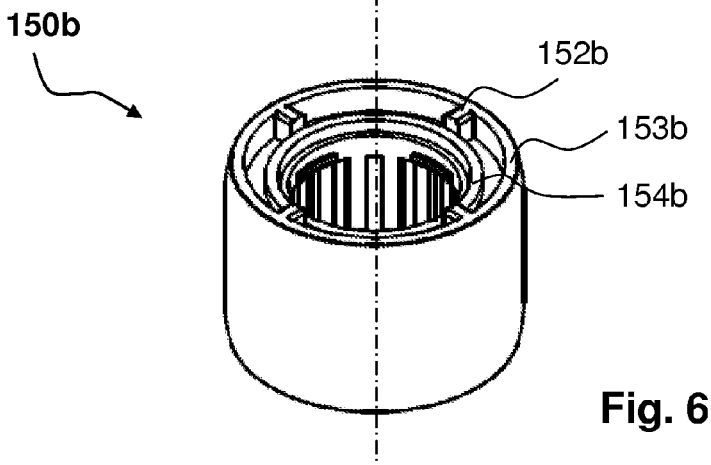

FIG. 6*b* shows the sliding sleeve 150*b* in a perspective top view. Four webs 152*b* are formed on the end face facing towards the closure cap 120*b*. They preferably extend radially in a circumferential groove between an outer wall 153*b* and an inner wall 154*b*. The inner face of the inner wall 154*b* is configured with a longitudinally profiled portion, whereby a non-rotatable retention on the storage container 110*b* can be accomplished. The sliding sleeve 150*b*, e.g. a plastic injection-molded part or an aluminum die-cast part, is formed as a single piece.

Figure 7:
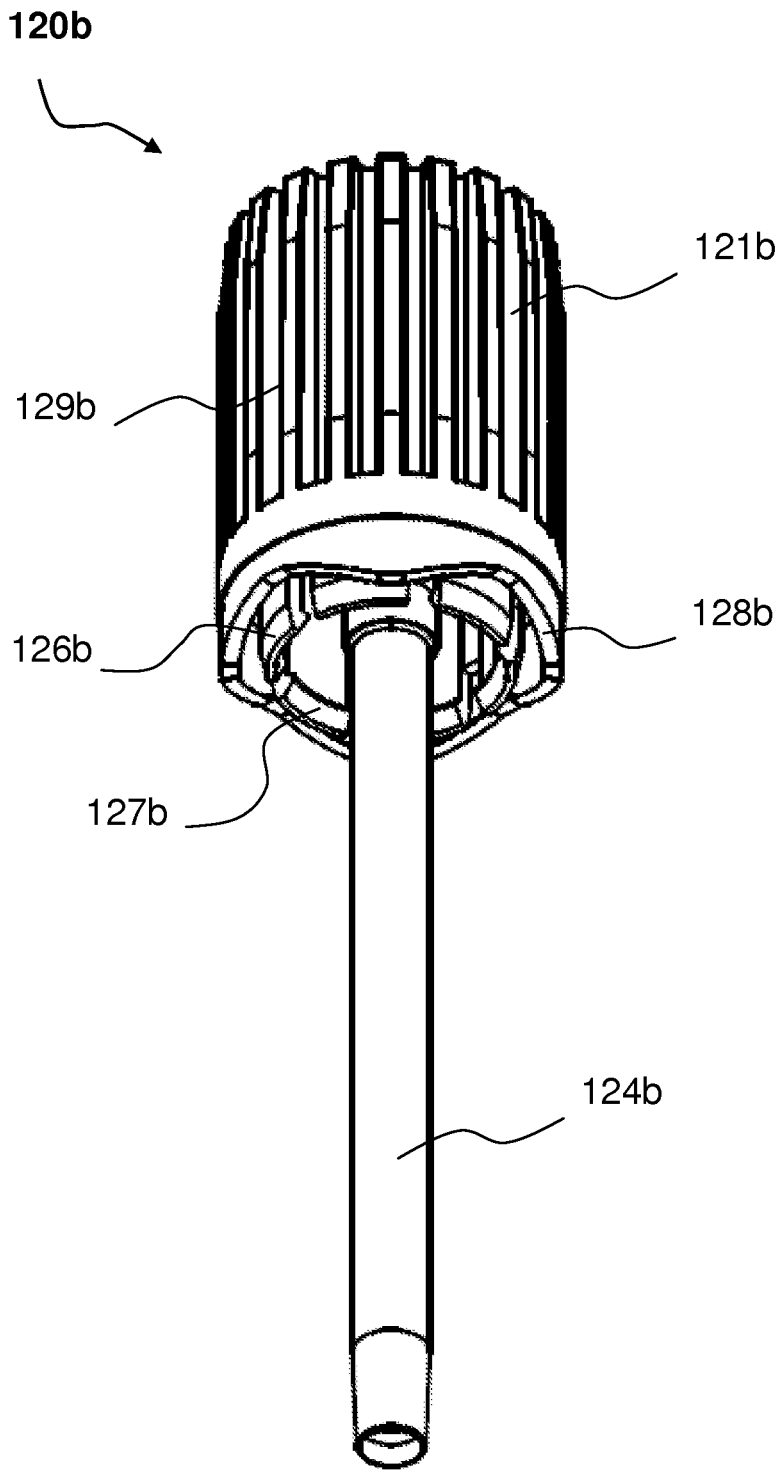
FIG. 7 shows a perspective view of the closure cap of the cosmetics container from FIG. 5.

FIG. 7 shows the closure cap 120*b* in a perspective bottom view. In the illustration shown, the latching hooks 126*b* with the radially inward-facing latching lugs 127*b* that are surrounded by an apron-like edge with the wave-like curve profile 128*b* can be seen very well. More generally, this may be referred to as the existence of a push-off bevel that converts a rotary movement of the closure cap 120*a* into a translational movement of the sliding member in the direction of the longitudinal axis L.

In the assembled state, the apron-like edge with the wave-like curve profile 128*b* engages the end-face circumferential groove on the sliding sleeve 150*b* (see FIG. 6*b*). This engagement is maintained by the spring device 160*b* (see FIG. 5). If the closure cap 120*b* is in its closing position, as shown in FIG. 5, the webs 152*b* are located in the troughs of the curve profile 128*b*. Due to the spring action of the spring device 160*b*, a rotary alignment between the closure cap 120*b* and the sliding sleeve 150*b* associated therewith takes place automatically.

If the closure cap 120*b* located in the closing position is moved relative to the storage container 110*b* by manually applying a rotary movement, which in FIG. 5 is indicated by a rotation-indicating arrow Aa, then the curve profile 128*b* formed on the closure cap 120*b* slides off the sliding sleeve 150*b* on the webs 152*b*. In the process, the webs 152*b* are pressed away in the axial direction by the curve profile 128, which rises from the troughs to the crests, and the sliding sleeve 150*b* is moved out of its blocking position. This is indicated by the arrow Ab in FIG. 5. By applying to the closure cap 120*b* an axially acting tensile force pointing away from the storage container 110*b*, the lock caused by the engaging latching hooks 126*b* can now be released and the closure cap 120*b* can be axially moved and finally removed from the storage container 110*b*. This is indicated by the arrow B in FIG. 5. Depending on the constructional design, the closure cap 120*b* can be moved in both or only in one direction of rotation in order to move the sliding sleeve 150*b* out of its blocking position. Moreover, a transmission ratio between the rotary movement and the longitudinal movement can be set by way of the design. The arrangement of the curve profile 128*b* and the webs 152*b* may also be reversed. Alternatively, a curve profile complementary to the curve profile 128*b* can be attached to the sliding sleeve, which then assumes the function of the webs 152*b*.

Figure 8:
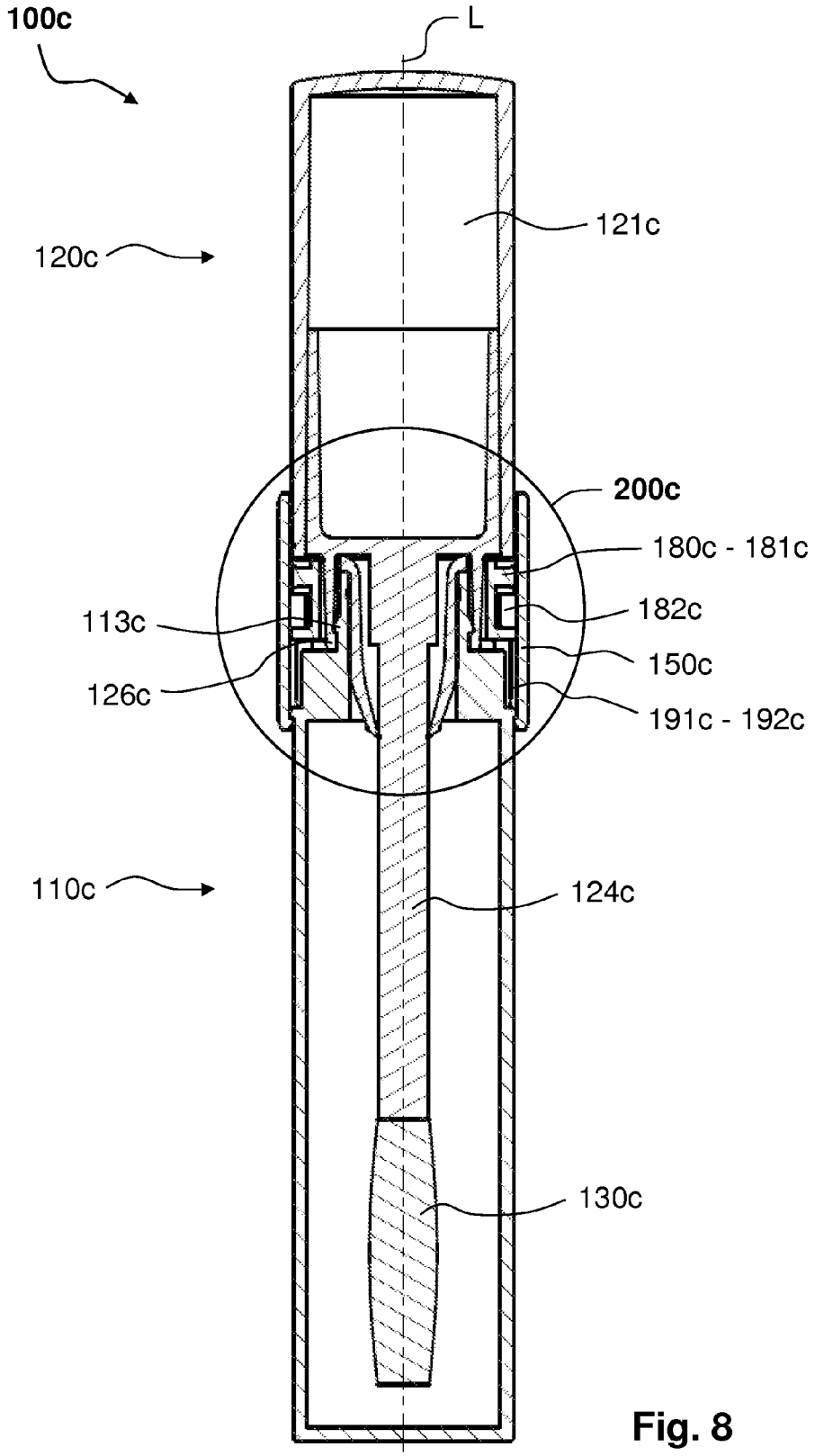
FIG. 8 shows a sectional view of a fourth exemplary embodiment of a cosmetics container according to the invention.

FIG. 8 shows a fourth exemplary embodiment of a cosmetics container 100*c* according to the invention.

Apart from the differences described below, the closure mechanism as such is identical to the closure mechanism of the first exemplary embodiment, so that the statements above in connection with the first exemplary embodiment also apply to this second exemplary embodiment unless the description below does not explicitly specify otherwise.

Deviating from the first exemplary embodiment, the cosmetics container 100*c* comprises a device or mechanism which aids or even automatically causes the lock between the mounted closure cap 120*c* and the storage container 110*c* caused by the engaging latching device 126*c* to be overcome when the closure cap 120*c* is removed from the storage container 110*c*, after the sliding sleeve 150*c* was moved from the blocking position into a release position. The second exemplary embodiment (see FIG. 4) also comprises such a mechanism, with the mechanism being designed differently in this case, as will be explained below in connection with FIG. 9.

Figure 9A:
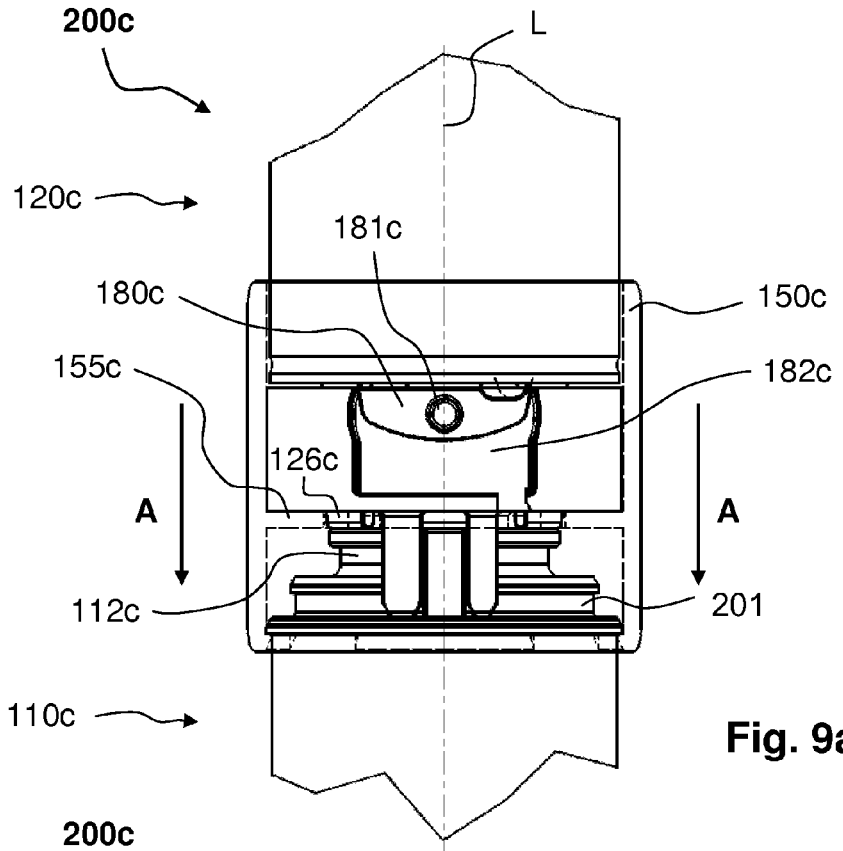
FIG. 9 shows two detailed sectional views of the closure mechanism of the cosmetics container from FIG. 8.

FIG. 9*a* shows a detailed view of the closure mechanism 200*c* according to the area marked in FIG. 8. In order to lock the closure cap 120*c* mounted on the storage container 110*c* in the closing position on the storage container 110*c* shown in FIG. 9*a*, latching hooks 126*c* of the type already described above in the first exemplary embodiment are provided, which, when the closure cap 120*c* is mounted on the storage container 110*c*, grasp over the neck 112*c* of the storage container 110*c* and by positive fit latch behind a projecting shoulder 113*c* on the outer face of the neck 112*c* (also see FIG. 8). In this state, the latching hooks 126*c* are blocked by a blocking ring 155*c* situated in the blocking position, so that the closure cap 120*c* cannot be readily moved out of the closing position and removed from the storage container 120*c*. The blocking ring 155*c* is formed as a radially inward-facing projection on the inner face of a sliding sleeve 150*c*. Alternatively or additionally, the bar or block of the latching hook 126*c* can also be effected by an inner face section on the sliding sleeve 150*c*.

In order to be able to remove the closure cap 120*c*, which is mounted on the storage container 110*c* and located in the closing position, from the storage container 110*c*, the sliding sleeve 150*c* first has to be moved out of the blocking position shown in FIG. 9*a*. To this end, the sliding sleeve 150*c* is manually moved away from the closure cap 120*c* in the axial direction, which is indicated by the arrows A in FIG. 9*a*, with the blocking ring 155*c* blocking the latching hooks 126*c* also being moved out of its blocking position. In the process, the radial block of the latching hooks 126*c* is canceled. Moreover, an opening force that acts in the axial direction is generated by one or preferably several tilting levers 180*c* pivotably mounted on the neck 112 of the storage container 110*c* and transferred onto the closure cap 120*c*, whereby the latching hooks 126*c* engaging behind the shoulder 113*c* are released and the closure cap 120*c* is axially pressed away from the storage container 110*c* and can finally be removed. This is indicated by the arrows B in FIG. 9*b*. In the following, reference will in each case only be made to "the tilting levers"; however, the statements apply mutatis mutandis in the case where only a single tilting lever is provided.

The tilting levers 180*c* are pivotably attached to an intermediate part 200 by fixed axes 181*c*. The intermediate part 200 is configured as a ring pushed onto the neck of the storage container 112*c* and preferably latched thereto. The latching arms 191*c* protruding from the intermediate part, which latch into a latching groove 201 on the neck of the storage container associated with them, serve for latching. Preferably, the intermediate part comprises at least two, preferably even three pairs of such latching arms, which are most frequently attached evenly distributed along the circumference of the intermediate part 200. As can be seen, the latching arms 191*c* grasp over a stop 192 attached to the storage container, whereby the intermediate part is non-rotatably fixed on the storage container.

The sliding sleeve 150*b* grasps over the intermediate part 200, preferably completely, in the fully assembled state. The intermediate part 200 thus lies in the intermediate space between the storage container and the sliding sleeve 150*c*.

Each of the tilting levers 180*c* is located in a recess 182*c* on the inner circumference of the sliding sleeve 150*c* in such a way that its capacity for pivoting is maintained.

The sliding sleeve is configured in such a way that it comes into contact with one arm, respectively, of each tilting lever in a positive fit, in such a way that the movement of the sliding sleeve 150*c* in the direction away from the closure cap 120*c* is transferred on to the respective arm of the tilting lever, which is then entrained by the sliding sleeve 150*c*. If the sliding sleeve 150*c* is manually moved out of its blocking position, the tilting levers 180*c* are, as a consequence, pivoted out of their initial neutral position (see FIG. 9*a*) by one arm, respectively, of these tilting levers 180*c* following the longitudinal movement of the sliding sleeve 150*c*. In the process, the respectively other arm is moved into the opposite direction due to the tilting effect. Due to this fact, this respectively other arm presses the closure cap 120*c* away from the storage container 110*c*. In the process, the respective arms of all pivot levers 180*c* directly or indirectly press against an edge on the closure cap 120*c* facing in the direction of the sliding sleeve 150*c* (which may also be solved by a different design) and produce an opening force acting against the lock of the spring or latching hooks 126*c*. By designing the tilting levers 180*c* or the length of both of their arms, a desired transmission ratio can be constructionally set if required.

Figure 9B:
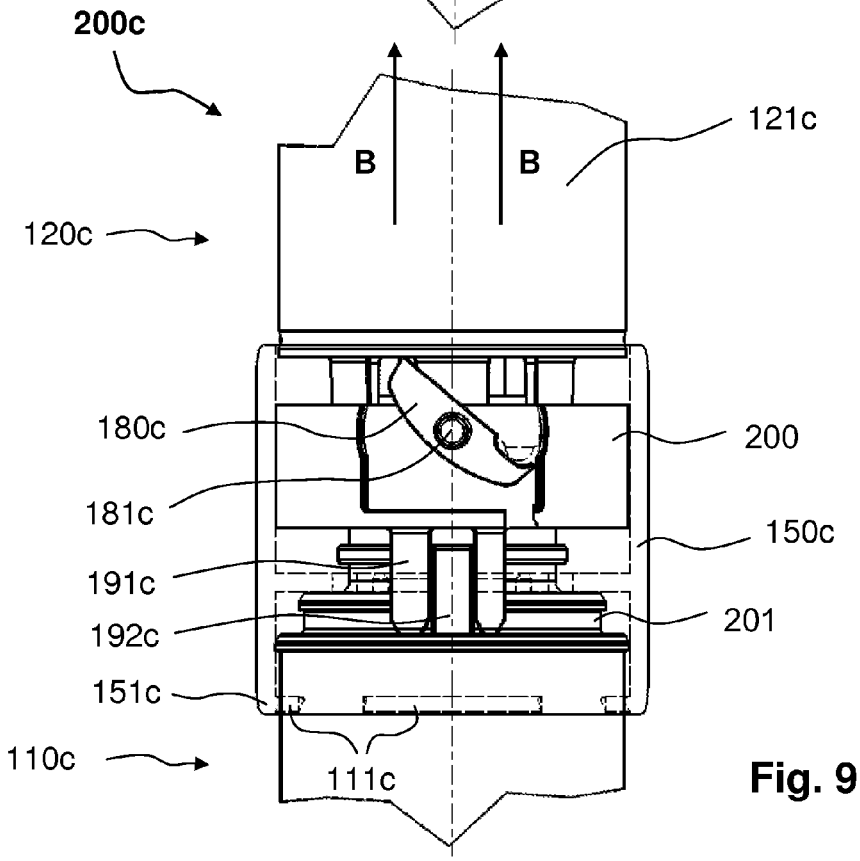

As can be seen in the FIGS. 9*a* and 9*b*, the sliding sleeve is preferably designed in such a way also in this case, that it comprises an edge in the area of the lower stop which grasps over a counter-stop on the storage container and thus securely retains the sliding sleeve on the storage container. In this case, the sliding sleeve is secured against rotation relative to the storage container.

Figure 10:
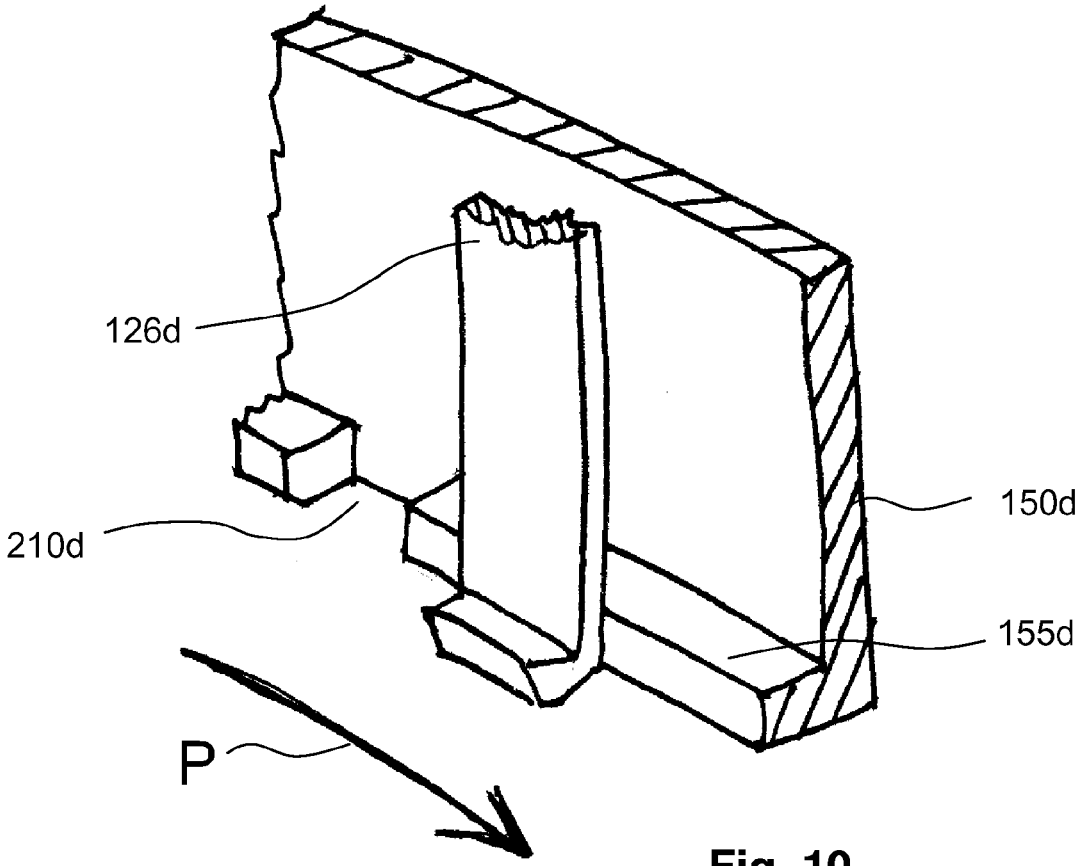
FIG. 10 outlines the basic mode of operation of a rotary sleeve to be used as an alternative to the sliding sleeve.

The rather schematic FIG. 10 shows that a rotary sleeve 150*d* may also be used instead of a sliding sleeve in order to block the latching device and in particular the latching hook 126*d*. As such, such a rotary sleeve has a comparable structure as described above in connection with the first embodiment with regard to the sliding sleeve. Thus, the rotary sleeve also comprises a blocking ring 155*d*. However, this blocking ring comprises a recess 210*d* for each of the latching hooks blocked by it. In order to cancel this block, the rotary sleeve 150*d* is rotated so far in the direction of the arrow P that the recess 210*d* (seen in the radial direction) is aligned with the associated latching hook, which is relatively easy to visualize based on the FIG. 10, which shows the locked state. Then, it is possible for the latching hook to give way in a radially outward direction, whereupon the closure cap can be removed in the manner described above in connection with the first exemplary embodiment.

This variation of principle can be used in particular for modifying the above-described first and second exemplary embodiments. The exemplary embodiments originating therefrom differ from the first and second exemplary embodiments only by the fact that the sliding sleeve there has been replaced in each case by a rotary sleeve according to the example described just now.

Figure 11:
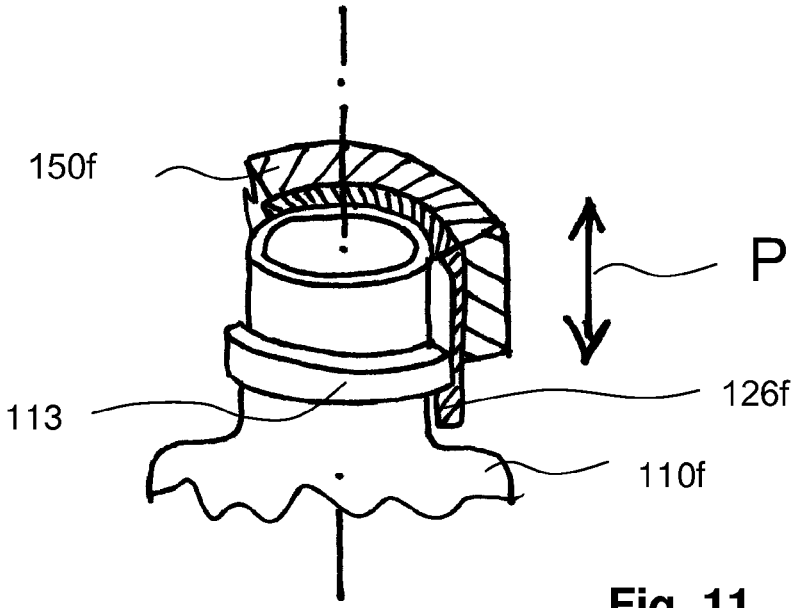
FIG. 11 outlines an alternative for the latching hooks in the form of a thin-walled latching sleeve closed in itself in the circumferential direction.

Finally, reference is to be made to FIG. 11. FIG. 11 shows a modification which can be used instead of the latching hooks described so far, in all of the exemplary embodiments explained so far. Here, the latching hooks used so far have become a latching sleeve 126*f* that is closed in itself in the circumferential direction. This latching sleeve 126*f* has at the end thereof facing towards the container bottom a latching bead extending all around in the circumferential direction, or at least local "latching buttons" (the latter are not shown) which latch into a latching depression which is edged in this case, purely by way of example, by the shoulder 113*f*. The latching sleeve is configured so thin-walled and/or so elastic that it expands in the circumferential direction and slides with its latching bead or its "latching buttons" over the shoulder 113*f*, which here is strip-like, when a tensile force with an opening effect is applied in the direction of the arrow P. Ideal wall thicknesses are in this case in the range of from 0.25 to 0.8 mm, depending on the elasticity of the selected material. In order to block the latching sleeve 126*f*, the sliding sleeve 150*f* is pushed downwards in the direction of the arrow P to such an extent that the expansion of the latching sleeve 126*f* is so severely impeded that the latching sleeve can no longer be pulled out of the latching depression.

The invention claimed is:

1. A cosmetics container for a liquid or pasty cosmetic, comprising:

a storage container having a removal opening, and a closure cap for opening and closing this removal opening, wherein the closure cap can be detachably locked in its closing position on the storage container with a plurality of latching elements that act between the closure cap and the storage container; and at least one locking element which is able to assume at least one release position and at least one blocking position, and which in the blocking position blocks at least one of the latching elements in such a way that a lock existing between the closure cap and the storage container cannot be released and the closure cap thus cannot be moved out of its closing position, wherein at least one of the latching elements has to become elastically deformed in order to unlatch, and the at least one locking element inhibits elastic deformation of the at least one latching element when in at least one of the blocking positions.

2. The cosmetics container according to claim 1, wherein the latching element comprises a latching hook, which is disposed on the closure cap or on the storage container and is configured to be resilient, such that the latching hook is able to resiliently engage a corresponding projection on the storage container or on the closure cap in order to effect the lock, and that the locking element situated in the blocking position blocks the resilient disengagement of the engaging latching hooks and thus prevents release of the lock.

3. The cosmetics container according to claim 1, wherein the locking element can be moved using an actuating element that is movably mounted on the storage container or on the closure cap, for which purpose this actuating element itself can be moved between at least one blocking position and at least one release position.

4. The cosmetics container according to claim 3, wherein the actuating element is biased into the blocking position by at least one spring device.

5. The cosmetics container according to claim 3, wherein the actuating element is a sliding sleeve mounted longitudinally displaceably on an outer face of the storage container so as to enclose a neck of the storage container.

6. The cosmetics container according to claim 5, further comprising a device or a mechanism that converts a rotary movement applied to the closure cap into a longitudinal movement of the sliding sleeve, whereby the sliding sleeve can be moved out of its blocking position by rotating the closure cap.

7. The cosmetics container according to claim 3, further comprising a device or a mechanism that automatically overcomes or at least helps overcome the lock caused by the latching element when the actuating element is moved out of its blocking position.

8. The cosmetics container according to claim 7, wherein the closure cap has at least a two-part configuration, whose parts are pressed axially apart by at least one spring device in order thus to generate an opening force acting against the lock.

9. The cosmetics container according to claim 7, further comprising at least one tilting lever which, by being pivoted, applies an opening force to the closure cap that acts against the lock, when the actuating element is moved out of its blocking position.

10. The cosmetics container according to claim 1, wherein the storage container is configured as a cylindrical elongate container and/or the closure cap is configured with a handle section and a carrier rod disposed thereon with an applicator.

* * * * *